US007267431B2

(12) United States Patent
Anderson et al.

(10) Patent No.: US 7,267,431 B2
(45) Date of Patent: Sep. 11, 2007

(54) MULTI-FLUID EJECTION DEVICE

(75) Inventors: Frank Edward Anderson, Sadieville, KY (US); Jeffery James Buchanan, Lexington, KY (US); Curtis Ray Droege, Richmond, KY (US); David Emerson Greer, Lexington, KY (US); Kin Ming Kwan, Lexington, KY (US); Gregory Alan Long, Georgetown, KY (US); Ganesh Vinayak Phatak, Lexington, KY (US); Paul Timothy Spivey, Lexington, KY (US); Carl Edmond Sullivan, Stamping Ground, KY (US); Kent Lee Ubellacker, Georgetown, KY (US); Melissa Marie Waldeck, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 251 days.

(21) Appl. No.: 10/881,961

(22) Filed: Jun. 30, 2004

(65) Prior Publication Data

US 2006/0001704 A1 Jan. 5, 2006

(51) Int. Cl.
*B41J 2/05* (2006.01)
*B41J 2/015* (2006.01)

(52) U.S. Cl. ..... 347/65; 347/20

(58) Field of Classification Search ..... 347/20, 347/54, 65

See application file for complete search history.

(56) References Cited

U.S. PATENT DOCUMENTS

| | | | |
|---|---|---|---|
| 4,951,063 | A | 8/1990 | Hawkins et al. |
| 5,006,202 | A | 4/1991 | Hawkins et al. |
| 5,065,170 | A | 11/1991 | Rezanka et al. |
| 5,308,442 | A | 5/1994 | Taub et al. |
| 5,441,593 | A | 8/1995 | Baughman et al. |
| 5,658,471 | A | 8/1997 | Murthy et al. |
| 5,738,757 | A | 4/1998 | Burns et al. |
| 5,812,165 | A | 9/1998 | Boyd et al. |
| 5,835,110 | A | 11/1998 | Sasaki |
| 5,907,338 | A | 5/1999 | Burr et al. |

(Continued)

FOREIGN PATENT DOCUMENTS

| | | |
|---|---|---|
| EP | 0401996 | 12/1990 |

(Continued)

OTHER PUBLICATIONS

U.S. Appl. No. 09/625,345, not published, Spivcy et al, copy of appl. included.

(Continued)

*Primary Examiner*—An H. Do
(74) *Attorney, Agent, or Firm*—Luedeka, Neely & Graham, PC

(57) ABSTRACT

A multi-fluid body and an ejection head substrate connected in fluid flow communication with the multi-fluid body for ejecting multiple fluids therefrom. The multi-fluid body includes at least two segregated fluid chambers. Independent fluid supply paths lead from each of the fluid chambers providing fluid to multiple fluid flow paths in the ejection head substrate. The ejection head substrate is attached adjacent an ejection head area of the body. The fluid flow paths in the ejection head substrate have a flow path density of greater than about one flow paths per millimeter.

20 Claims, 17 Drawing Sheets

U.S. PATENT DOCUMENTS 5,963,234 A * 10/1999 Miyazawa et al. ..... 347/70
6,019,465 A 2/2000 Shinada et al.
6,019,907 A 2/2000 Kawamura
6,042,225 A 3/2000 Altendorf et al.
6,162,589 A 12/2000 Chen et al.
6,209,993 B1 4/2001 Wang et al.
6,260,961 B1 7/2001 Seu et al.
6,273,557 B1 8/2001 Milligan et al.
6,290,348 B1 9/2001 Becker et al.
6,341,845 B1 1/2002 Scheffelin et al.
6,350,023 B1 2/2002 Silverbrook
6,402,301 B1 6/2002 Powers et al.
6,409,323 B1 * 6/2002 Silverbrook ..... 347/85
6,449,831 B1 9/2002 Komplin et al.
6,463,656 B1 10/2002 Debesis et al.
6,523,940 B2 2/2003 Scheffelin et al.
6,534,247 B2 3/2003 Milligan et al.
6,582,069 B2 6/2003 Ohashi et al.
6,592,202 B2 7/2003 Udagawa et al.
2002/0145647 A1 10/2002 Kataoka et al.
2003/0027426 A1 2/2003 Milligan et al.
2003/0141279 A1 7/2003 Miller et al.
2003/0160841 A1 8/2003 Takata et al.

FOREIGN PATENT DOCUMENTS

WO WO 03018315 3/2003

OTHER PUBLICATIONS

Eberhardt et al., "Low Cost Fabrication Technology for Microfluidic Devices Based on Micro Injection Moulding," Proc. Micro.tec 2003, Oct. 2003, pp. 129-134, Germany.
Yamasaki et al., "Three-Dimensional Micro-Channels in Polymers: One-Step Fabrication", Applied Physics A, vol. 77, No. 3-4, pp. 371-373 (2003).
Kocheny et al., "Three Approaches in Utilizing High Power Diode Laser to Join Thermoplastics," http://www.leisterlaser.com/PDFs/article1.pdf (printed on Jun. 29, 2004).

* cited by examiner

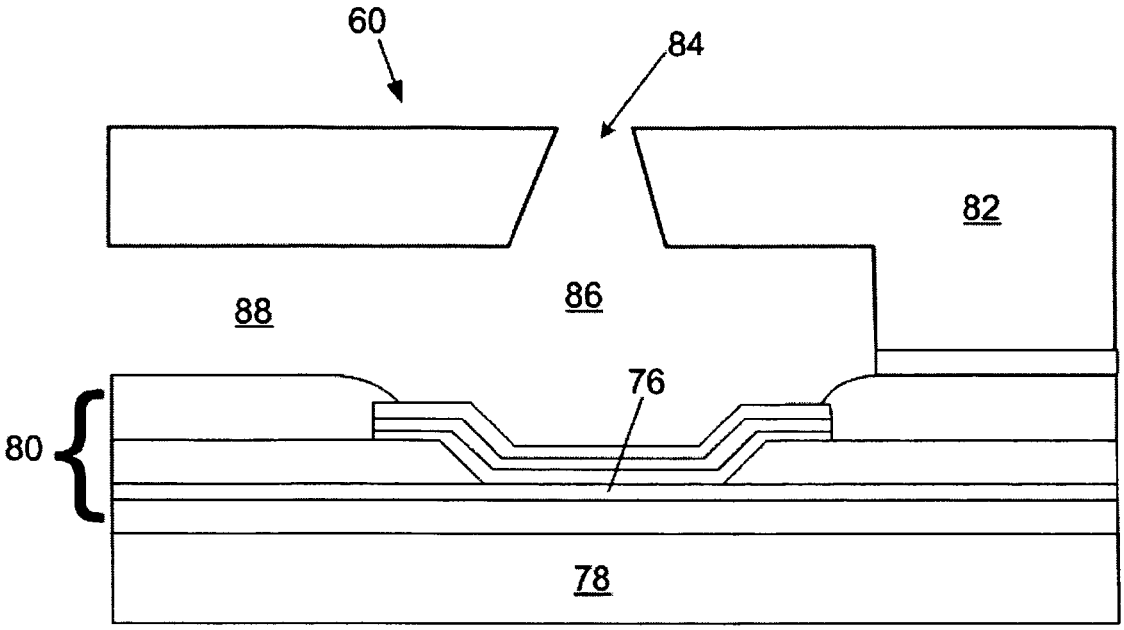
FIG. 6
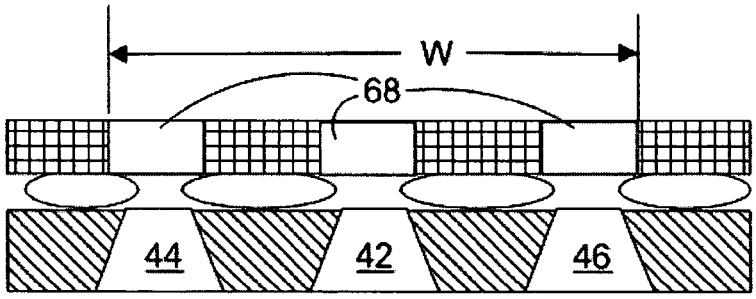
FIG. 7
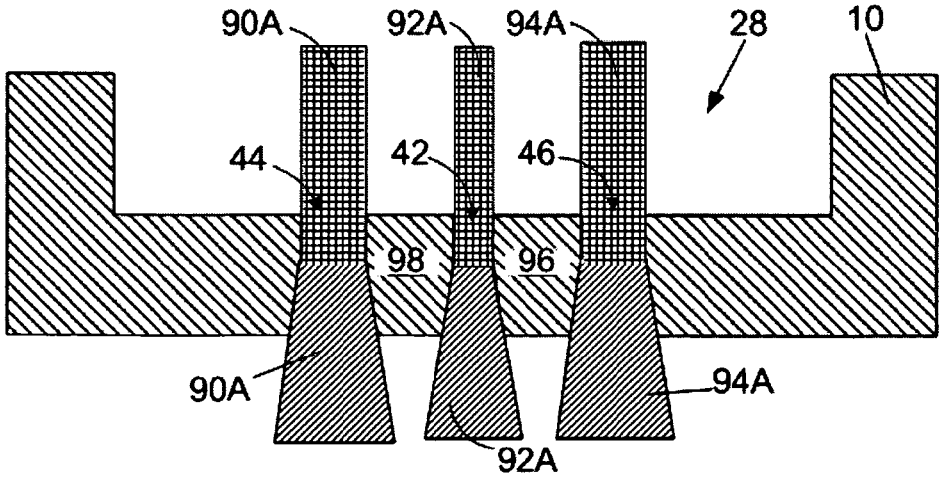
FIG. 8 - Prior Art

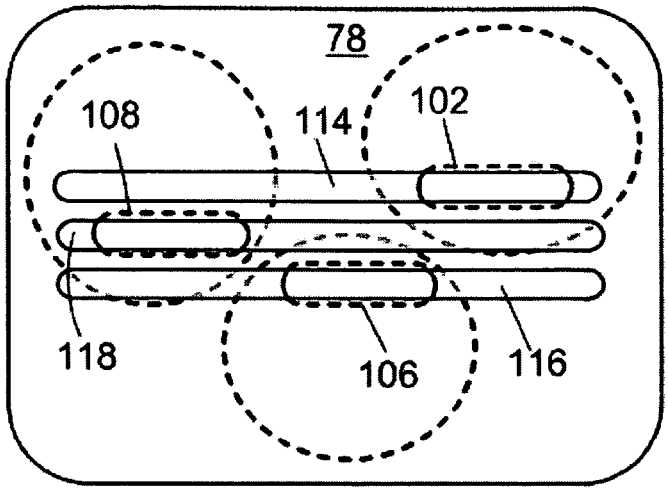
FIG. 15
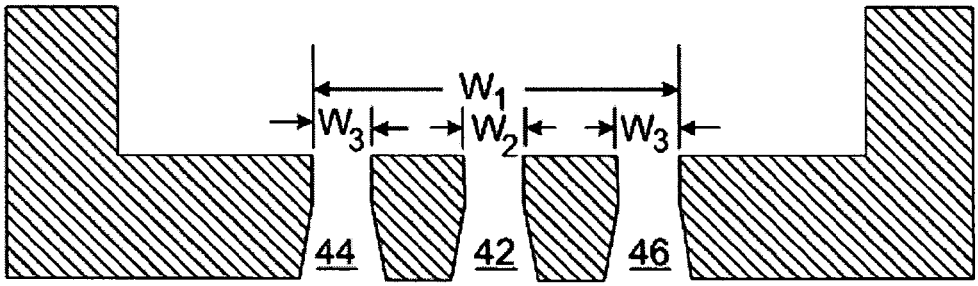
FIG. 16 - Prior Art
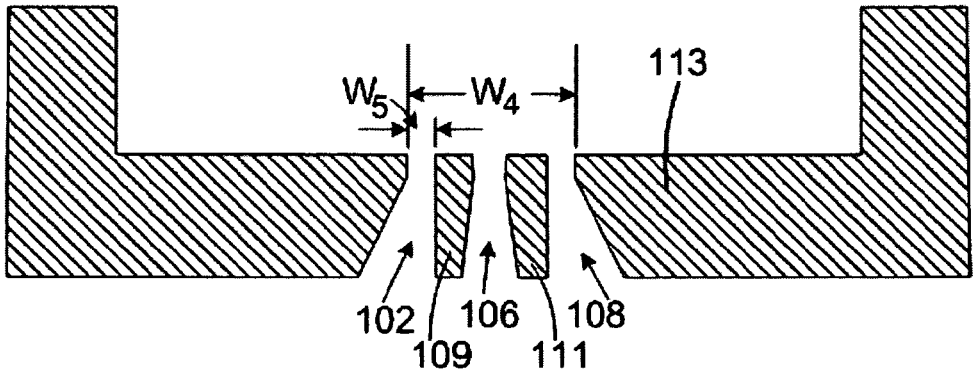
FIG. 17

FIG. 31
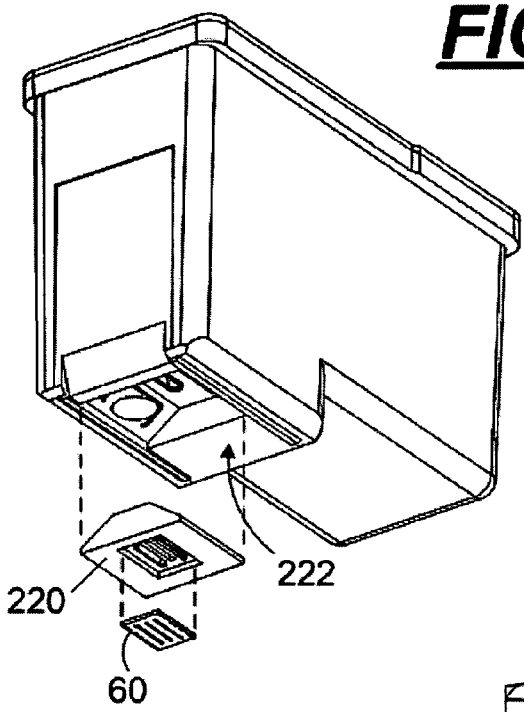
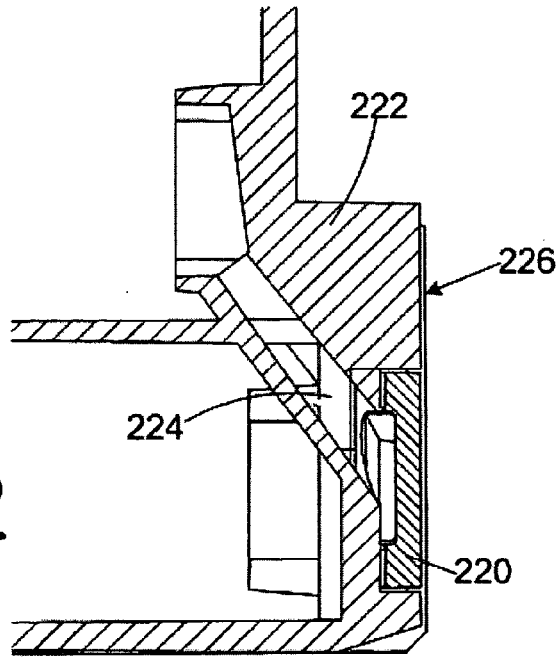
FIG. 32
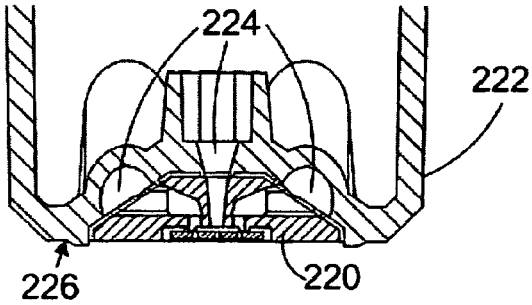
FIG. 33

FIG. 34
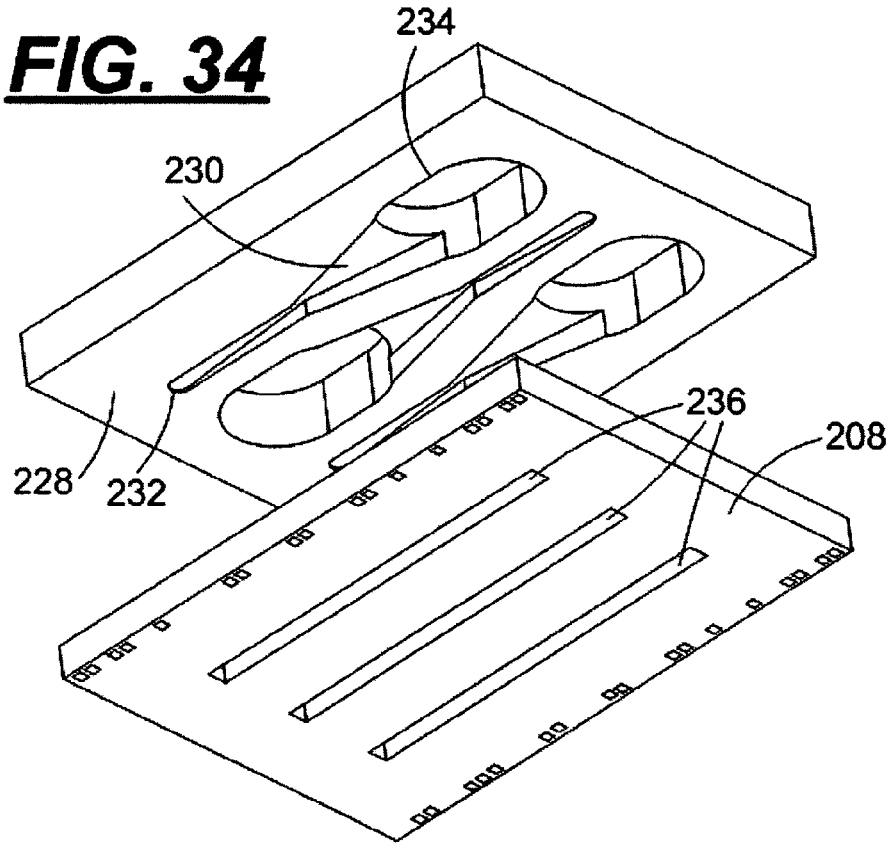
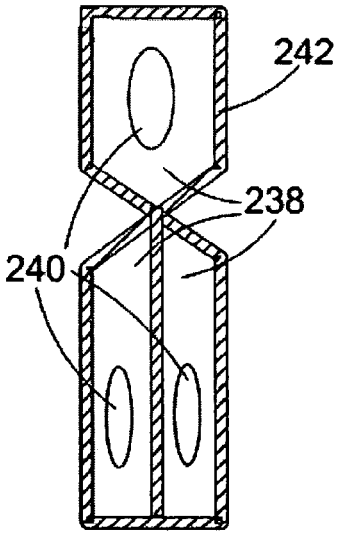
FIG. 35
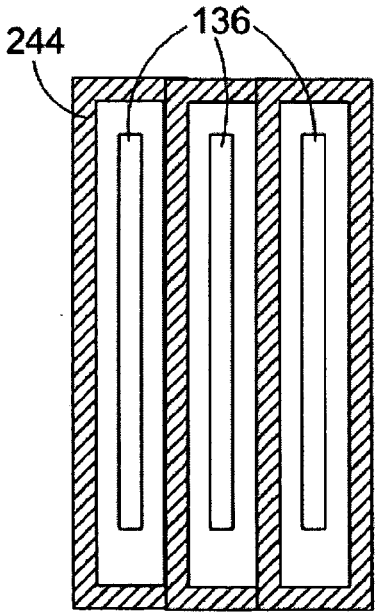
FIG. 36
Prior Art

MULTI-FLUID EJECTION DEVICE

FIELD OF THE DISCLOSURE

The disclosure relates to micro-fluid ejection devices and in particular to structures and techniques for supplying multiple fluids to a multi-fluid ejection head from a multi-fluid reservoir.

BACKGROUND

In the field of micro-fluid ejection devices, ink jet printers are an exemplary application where miniaturization continues to be pursued. However, as micro-fluid ejection devices get smaller, there is an increasing need for unique designs and improved production techniques to achieve the miniaturization goals. For example, the increasing demand of putting more colors in a single ink jet cartridge requires the addition of fluid flow passageways from the cartridge body to the ejection head that, without radical changes in production techniques, will require larger ejection head substrates. However, the trend is to further miniaturize the ejection devices and thus provide smaller ejection head substrates. An advantage of smaller ejection head substrates is a reduction in material cost for the ejection heads. However, this trend leads to challenges relating to manufacturing techniques typically used for making such devices.

As the ejection heads are reduced in size, it becomes increasingly difficult to adequately segregate multiple fluids in the cartridges from one another yet provide the fluids to different areas of the ejection heads. One of the limits on spacing of fluid passageways in the ejection head substrate is an ability to provide correspondingly small, and closely-spaced passageways from the fluid reservoir to the ejection head substrate. Another limit on fluid passageway spacing is the ability to adequately align the passageways in the fluid reservoir with the passageways in the ejection head substrate so that the passageways are not partially or fully blocked by an adhesive used to attach to the ejection head to the reservoir.

Thus, there continues to be a need for improved structures and manufacturing techniques for multi-fluid reservoirs and ejection head components for ejecting multiple fluids onto a medium.

SUMMARY

With regard to the foregoing, the disclosure provides a multi-fluid body and an ejection head substrate connected in fluid flow communication with the multi-fluid body for ejecting multiple fluids therefrom. The multi-fluid body includes at least two segregated fluid chambers. Independent fluid supply paths lead from each of the fluid chambers providing fluid to multiple fluid flow paths in the ejection head substrate. The ejection head substrate is attached adjacent an ejection head area of the body. The fluid flow paths in the ejection head substrate have a flow path density of greater than about one flow paths per millimeter.

In a second embodiment, the disclosure provides a method for making a micro-fluid ejection device containing a micro-fluid ejection head for ejecting multiple-fluids therefrom. The method includes providing a multi-fluid body for ejecting multiple fluids onto a medium. The body includes a body structure having exterior side walls and a bottom wall forming an open-topped, interior cavity; an ejection head area disposed adjacent a portion of the bottom wall opposite the interior cavity; at least two segregated fluid chambers within the interior cavity of the body; and independent fluid supply paths extending from each of the fluid chambers to the ejection head area of the body. The ejection head containing an ejection head substrate is attached to the ejection head area of the multi-fluid body. The ejection head substrate contains fluid flow paths therein corresponding to the fluid supply paths in the body, wherein the fluid flow paths in the ejection head substrate have a flow path density of greater than about 1.00 flow paths per millimeter.

An important advantage of certain embodiments disclosed herein is that multiple different fluids can be ejected from a micro-fluid ejection device that is less costly to manufacture and has dimensions that enable increased miniaturization of operative parts of the device. Continued miniaturization of the operative parts enables micro-fluid ejection devices to be used in a wider variety of applications. Such miniaturization also enables the production of ejection devices, such as printers, having smaller footprints without sacrificing print quality or print speed. The apparatus and methods described herein are particularly important for reducing the size of a silicon substrate used in such micro-fluid ejection devices without sacrificing the ability to suitably eject multiple different fluids from the ejection device.

BRIEF DESCRIPTION OF THE DRAWINGS

Further advantages of the embodiments described herein will become apparent by reference to the detailed description of exemplary embodiments when considered in conjunction with the drawings, wherein like reference characters designate like or similar elements throughout the several drawings as follows:

FIG. 6 is a cross-sectional view, not to scale of a micro-fluid ejection head;

FIG. 7 is a cross-sectional view not to scale of a portion of a micro-fluid ejection head attached to a multi-fluid body showing multiple fluid paths in the head and body;

FIG. 8 is a cross-sectional view, not to scale, of a portion of a prior art body and core pins for molding fluid paths in the body;

FIGS. 13-15 are plan views, not to scale, of a body and flow paths therein made according to the disclosure;

FIG. 16 is a cross-sectional view, not to scale, of a prior art body having fluid supply paths therein;

FIG. 17 is a cross-sectional view, not to scale, of a body having fluid supply paths therein made according to the disclosure;

FIG. 31 is an exploded view, not to scale, of a body and manifold for a semiconductor substrate according to a second embodiment of the disclosure;

FIG. 32 is a side cross-sectional view of a body and manifold for a semiconductor substrate according to the second embodiment of the disclosure the disclosure;

FIG. 33 is front cross-sectional view, not to scale, of a semiconductor substrate and manifold attached to a body according to the second embodiment of the disclosure;

FIG. 34 is an exploded perspective view, not to scale, of a manifold and a semiconductor substrate according to a third embodiment of the disclosure;

FIG. 35 is a plan view, not to scale of an adhesive pattern for a manifold attachment to a body according to the third embodiment of the disclosure;

FIG. 36 is a plan view, not to scale of a prior art adhesive pattern for a substrate attachment to a body;

DETAILED DESCRIPTION

Figure 1:
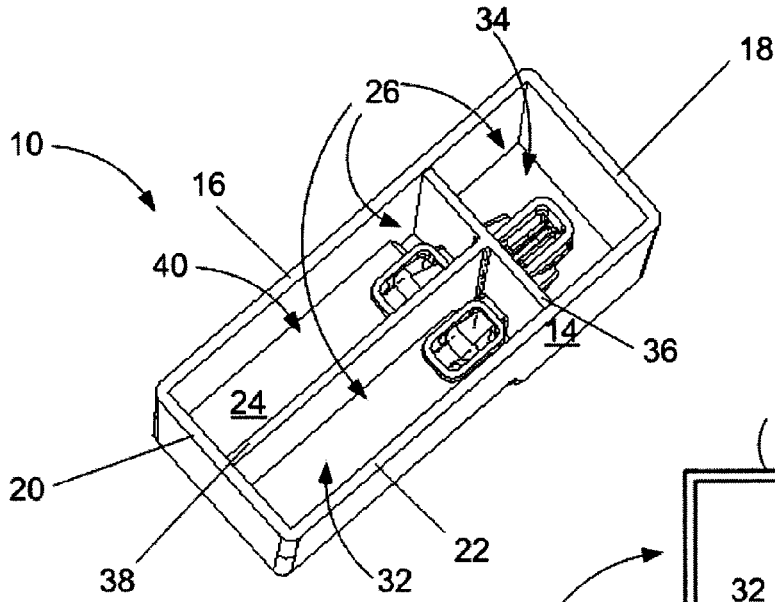
FIG. 1 is a top perspective view of an inside cavity of a multi-fluid body according to a first embodiment of the disclosure.
Figure 3:
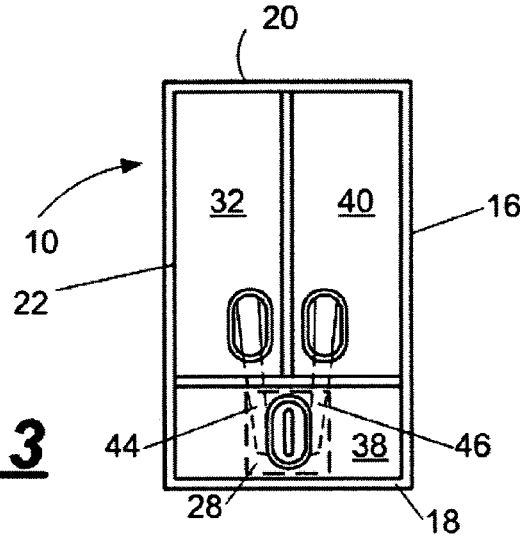
FIG. 3 is a top plan view of a multi-fluid body according to the first embodiment of the disclosure.
Figure 4:
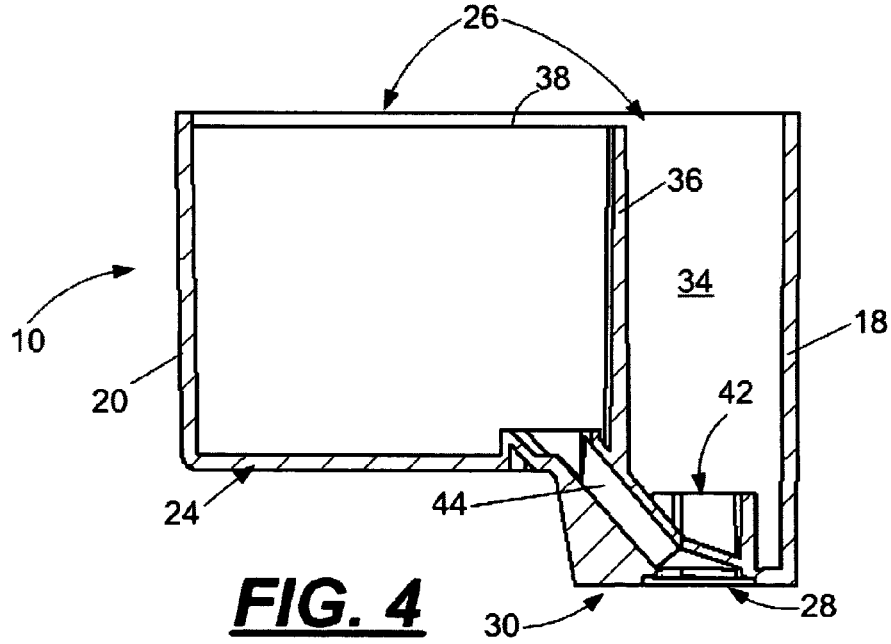
FIG. 4 is a side cross-sectional view of a multi-fluid body according to the first embodiment of the disclosure.
Figure 2:
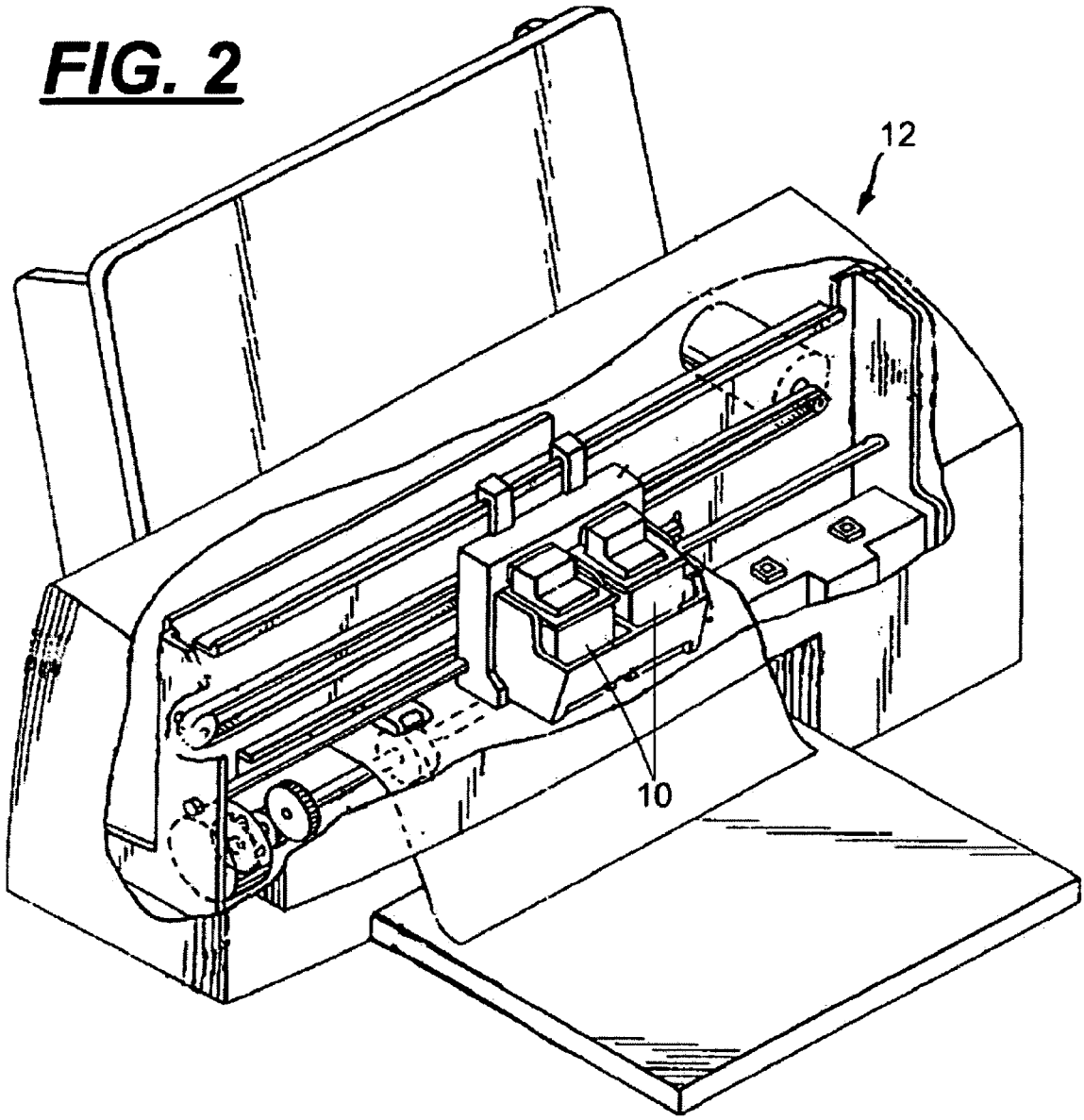
FIG. 2 is a perspective view of a micro-fluid ejection device.

With reference to FIGS. 1-4, a multi-fluid body 10 for a micro-fluid ejection device, such as an ink jet printer 12 is illustrated. The multi-fluid body 10 includes a body structure 14 having exterior side walls 16, 18, 20, and 22 and a bottom wall 24 forming an open-topped, interior cavity 26. An ejection head area 28 is disposed adjacent a portion 30 of the bottom wall 24 opposite the interior cavity 26. At least two segregated fluid chambers 32 and 34 are provided within the interior cavity 26 of the body 10. A dividing wall 36 separates chamber 32 from chamber 34. An additional dividing wall 38 may be provided to separate chamber 40 from chamber 32 for a body 10 containing three different fluids. Independent fluid supply paths are provided from each of the fluid chambers 32, 34, and 40 to provide fluid to an ejection head attached to the ejection head area 28 of the body 10.

The body structure 12 is preferably molded as a unitary piece in a thermoplastic molding process. The body structure 12 is preferably made of a polymeric material selected from the group consisting of glass-filled polybutylene terephthalate available from G.E. Plastics of Huntersville, N.C. under the trade name VALOX 855, amorphous thermoplastic polyetherimide available from G.E. Plastics under the trade name ULTEM 1010, glass-filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene ether/polystyrene alloy resin available from G.E. Plastics under the trade names NORYL SE1, NORYL 300X, NORYL N1250, NORYL N1251, and polyamide/poly-phenylene ether alloy resin available from G.E. Plastics under the trade name NORYL GTX. A preferred material for making the body structure 12 is NORYL N1250 or NORYL N1251 resin.

Providing two or more chambers 32, 34, and 40 in a single body 10 increases the technical difficulties of using an injection molding process for making the body 10. If the body 10 is to be molded from a polymeric material as a single molded unit, there are significant challenges to molding suitable fluid supply paths in the body 10 to the ejection head area 28 using conventional mold construction and molding techniques. Such challenges include, but are not limited to, the complexity of cooling and filling the mold used for the injection molding process.

Figure 5:
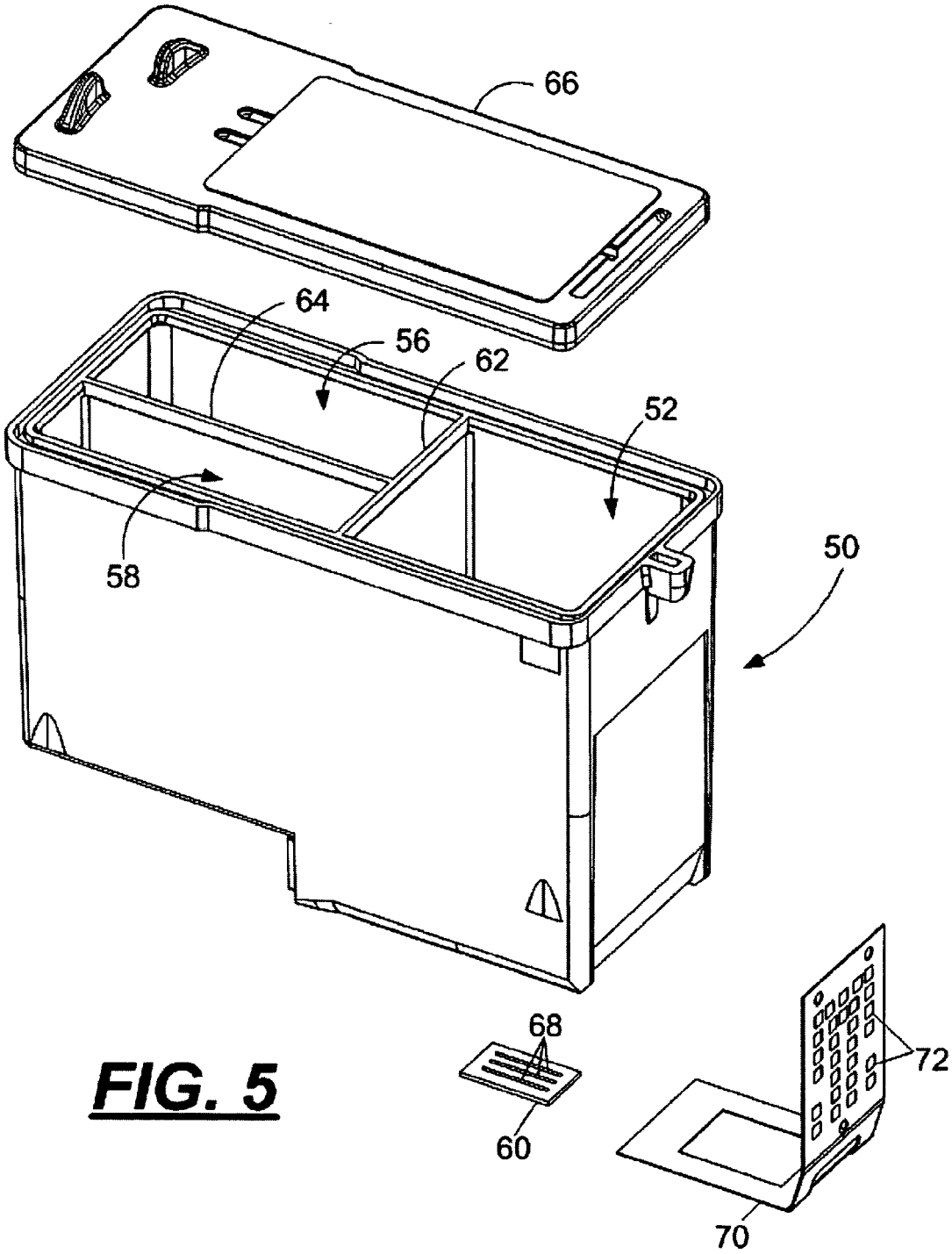
FIG. 5 is a perspective exploded view of a multi-fluid body according to a second embodiment of the disclosure.
Figure 9:
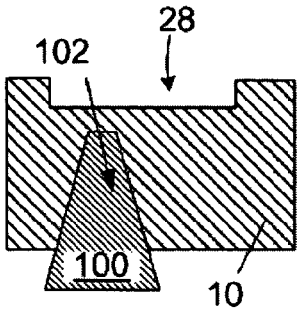
FIGS. 9-11 are cross-sectional views, not to scale, of a process for forming paths in a body according to the disclosure.

Another multi-fluid body 50 is illustrated in FIG. 5. The body 50 illustrated in FIG. 5 contains three separate fluid chambers 52, 56, and 58 for three independently supplied fluids to an ejection head 60. Dividing walls 62, and 64 are provided in the body 50 to isolate chambers 52, 56, and 58 from each other for providing three different fluids to the ejection head 60. The fluids are retained in the chambers 52, 56, and 58 by a cover 66 attached to the fluid body 50.

The ejection head 60 contains fluid ejection actuators such as heater resistors or piezoelectric devices to eject fluid from the ejection head 60. Fluid to the actuators is provided from the body 50 through corresponding fluid flow paths 68 in the ejection head 60. A flexible circuit 70 containing electrical contacts 72 thereon is provided and attached to the ejection head 60 and body 50 to provide electrical energy to the actuators when the body 10 or 50 is attached to an ejection device such as ink jet printer 12.

A typical fluid ejection head 60 is illustrated in FIG. 6. In FIG. 6, the fluid ejection head 60 contains a thermal fluid ejection device 76. The head 60 includes a semiconductor substrate 78 containing multiple conductive, insulative, and protective layers 80 for forming and protecting the fluid ejection device 76. A nozzle plate 82 containing a nozzle hole 84 is attached to the substrate 78 and layers 80 to provide a fluid ejection chamber 86. Fluid flows to the fluid ejection chamber 86 through a fluid supply channel 88 that is in flow communication with the fluid flow paths 68 in the head 60.

As the number of fluid supply paths 42, 44, and 46 in the body 10 and fluid flow paths 68 in the head 60 increase, it becomes increasingly difficult to align and attach the ejection head 60 to the ejection head area 28 of the body 10 while increasing the number of fluid flow paths 68 per width W of the ejection head 60 (FIG. 7).

By way of further background, reference is made to FIG. 8 which illustrates a prior art device made using a conventional method for forming fluid supply paths 42, 44 and 46 in the ejection head area 28 of a multi-fluid body 10. FIG. 8 shows a cross section of a typical conventional ejection head area 28 with removable core pins 90A-90B, 92A-92B, and 94A-94B used during a molding process for the body 10 to create fluid supply paths 42, 44, and 46 in the body 10. Each of the core pins is provided by A and B sections that are inserted and removed from opposite sides of the body 10. The core pins 90A-90B, 92A-92B, and 94A-94B necessarily have a size sufficient to survive the molding process. Likewise, spacings 96 and 98 between the pins 90A-90B, 92A-92B, and 94A-94B must be wide enough to allow plastic to flow. The limitations of the core pin size and the spacings 96 and 98 directly impact the ability to reduce the spacing between adjacent supply paths 42, 44, and 46. Because the supply paths 42, 44, and 46 must align with the fluid flow paths 68 in the ejection head 60, the foregoing limitations also directly impact the minimum size of an ejection head 60 made by conventional techniques.

In order for the fluid supply paths 42, 44, and 46 to be moved closer together, the core pins 90A-90B, 92A-92B, and 94A-94B would necessarily have to be substantially smaller. However, smaller core pins 90A-90B, 92A-92B, and 94A-94B are less able to survive a molding process as they would be too weak to be suitably removed from the molded body 10.

Figure 10:
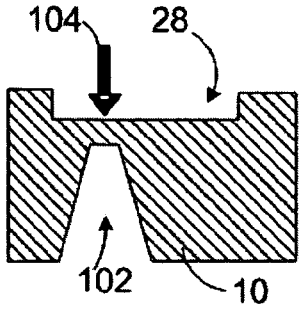
Figure 11:
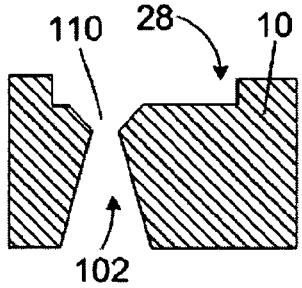
Figure 12:
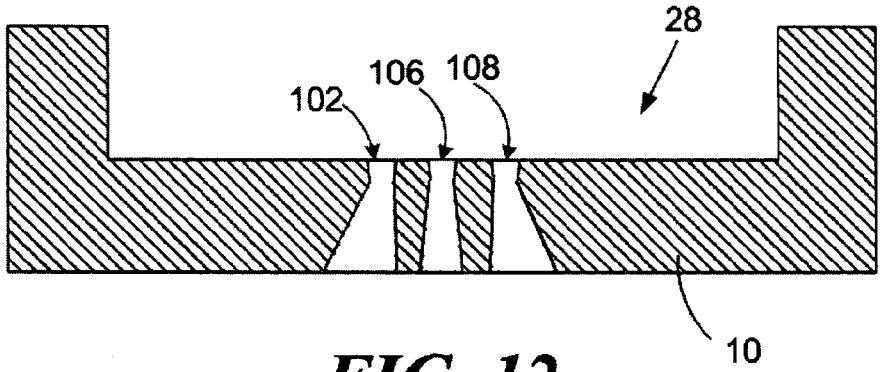
FIG. 12 is a cross-sectional view, not to scale, of a body made according to the disclosure.

A method according to the disclosure for providing more closely spaced fluid supply paths while providing suitable flow of polymer between the supply paths is illustrated in FIGS. 9-12. According to the illustrated method, a core pin 100 provides partial forming of the fluid supply path 102 in the body 10. The core pin 100 is removed from the body 10 after molding and a secondary micro-machining operation 104 is conducted as shown in FIGS. 10 and 11 to complete the fluid supply path 102 in the body 10. The micro-machining operation 104 opens the fluid supply path 102 from the ejection head area 28 side of the body 10 to mate up with the partially formed supply path 102 created by the core pins 100. As shown in FIG. 12, the fluid supply path 102 and fluid supply paths 106 and 108 may be made smaller and located closer together than the fluid supply paths 42, 44 and 46 made by conventional techniques (FIG. 8). In the two step process illustrated in FIGS. 9-11, the core pins 100 are removed so that the pins 100 are not damaged by the micro-machining process 104.

Suitable micro-machining processes 104 include, but are not limited to laser ablation, laser cutting, grit blast, water jet, milling, or punching. Of the foregoing procedures, laser ablation is preferred due to an ability to more precisely control the location and dimensions of the fluid paths 102. The shape and size of the opening 110 on the ejection head area 28 side of the body 10 is determined by a mask which is accurate to less than a micron. The depth of ablation is also very controllable and less debris is present than with a process such as grit blast.

Virtually all types of polymers absorb UV laser energy in the range of about 100 to about 300 nanometers and thus may be ablated with this method. Currently features are ablated in polyimides in the micron range. Accordingly, a fluid supply path that could not be molded smaller than 400 or 500 μm through normal molding steps may be ablated in a polymeric material at a dimension or opening size of less than 10 μm. A micro-machining process 104 such as laser ablation enables a reduction in the ejection head 60 size that mates to the fluid supply paths 102, 106, and 108 in the body. A reduction in the ejection head 60 size reduces the size of semiconductor substrate 78 needed thereby lowering the overall cost of the ejection head 60. Depending on the desired surface energy of the ablated fluid supply paths 102, 106 and 108 in the body 10, a plasma process may be implemented after the laser ablation step to further improve fluid wetting in the supply paths 102, 106, and 108.

Figure 13:
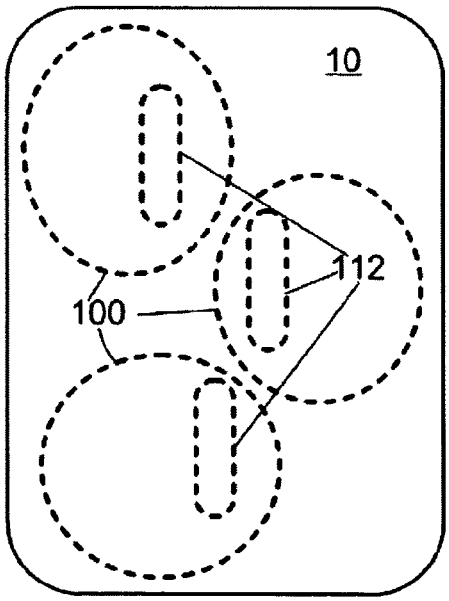
Figure 14:
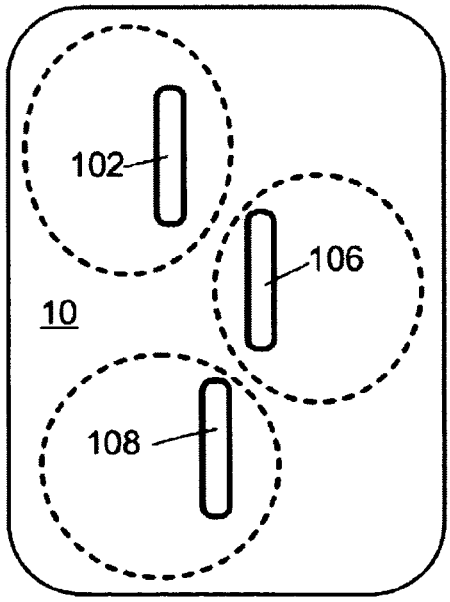

FIGS. 13 and 14 are top plan views from the ejection head area 28 side of the body 10 illustrating the location of core pins 100 for forming fluid supply paths 102, 106, and 108 in the body 10. In FIG. 13, the core pins 100 do not extend all of the way through the body 10 and thus the upper portion of the core pins 100 are illustrated by dashed lines 112. In FIG. 14, the core pins 100 have been removed and the fluid supply paths 102, 106, and 108 are opened up from the ejection head area 28 side of the body 10 by ablating the area enclosed by the solid lines as described above. FIG. 15 is a top plan view from the ejection head area 28 side of the ejection head 60 showing the substrate 78 containing fluid flow paths 114, 116, and 118 therein corresponding to the fluid supply paths 102, 106, and 108 superposed on the body 10.

By using a two-step process to form the fluid supply paths 102, 106, 108 in the body 10 that will align with the fluid flow paths 114, 116, 118 in the substrate 78, a body and corresponding ejection head having a much higher fluid path packing density can be provided. The number of fluid supply paths within a given linear dimension is defined as the flow path density. FIGS. 16 and 17 illustrate the improvement in fluid supply path density. In FIG. 16, the length $W_1$ is 3.4 millimeters and fluid supply path 42 has a minimum width $W_2$ of about 0.80 millimeters. Each of the fluid supply paths 44 and 46 has a minimum width $W_3$ of about 0.66 millimeters, thus giving a fluid supply path density of about 0.87 flow paths per millimeter for three fluid supply paths over the length $W_1$. In FIG. 17, the width $W_4$ ranges from about 0.35 to about 2.0 millimeters. Each of the fluid supply paths 102, 106, and 108 has a minimum width $W_5$ ranging from about 0.05 to about 0.4 millimeters, thus giving a fluid supply path density ranging from greater than 1.00 flow paths per millimeter up to about 3.0 flow paths per millimeter. Accordingly, the foregoing embodiment enables the fluid flow paths density in the ejection device to be increased above about 1.00 flow paths per millimeter.

Figure 18:
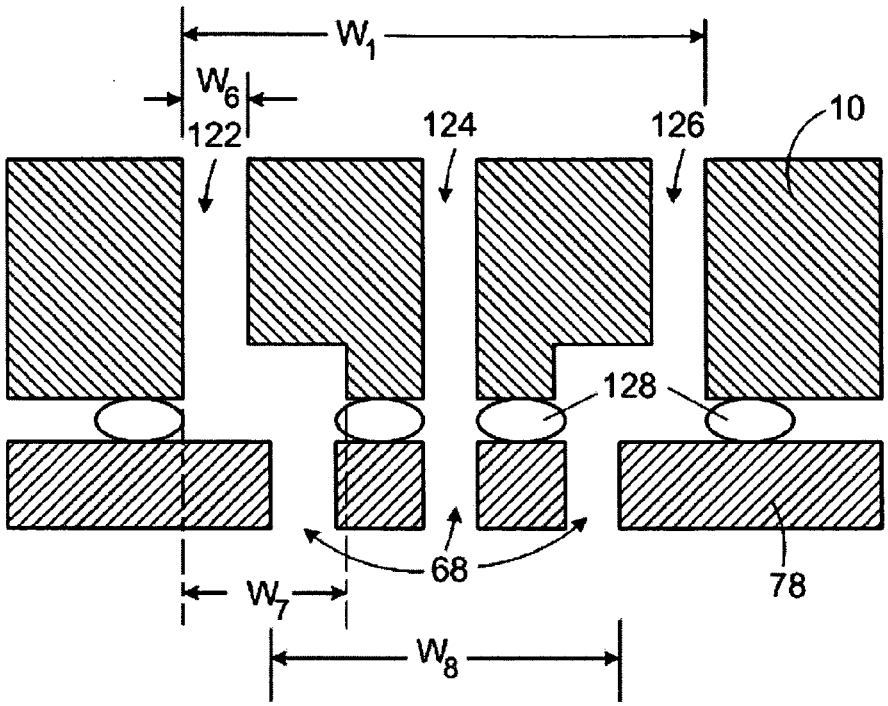
FIG. 18 is a cross-sectional view, not to scale, of a body made according to another embodiment of the disclosure.

In an alternative design, a body having a stepped fluid supply path design is illustrated in FIG. 18. In this case, fluid supply paths 122 and 126 have an entrance width $W_6$ and an exit width $W_7$. The variable width of the fluid supply paths 122 and 126 reduce the contact area for an adhesive 128 between the body 10 and the substrate 78 allowing the fluid flow paths 68 on the substrate 78 to be placed closer together. Accordingly, the fluid flow paths 68 on the substrate are provided within a width of $W_8$ that is substantially less than the width $W_1$ to provide a fluid flow path density ranging from greater than about 1.00 $mm^{-1}$ up to about 3.0 $mm^{-1}$.

Improved materials and molding technology enable molding fluid supply paths in a body as described above with reference to FIG. 17 or 18. In order to increase the density of the fluid supply paths 102, 106, and 108, the walls 109 and 111 between the supply paths should be made as narrow as possible while still providing sufficient surface area for adhesively attaching the substrate 78 to a body 113 (FIG. 17). Accordingly, the minimum wall width preferably ranges from about 0.15 to about 0.25 millimeters. For molding purposes, a polyethylene terephthalate material may provide sufficient mold filling and mechanical properties for the walls.

Figure 20:
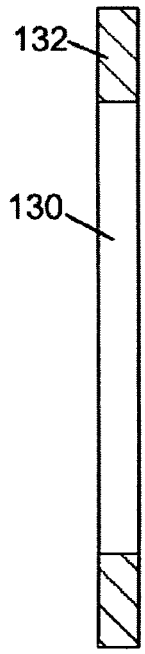
FIG. 20 Prior Art
FIG. 20 is a cross-sectional view, not to scale, of a prior art semiconductor substrate.
Figure 21:
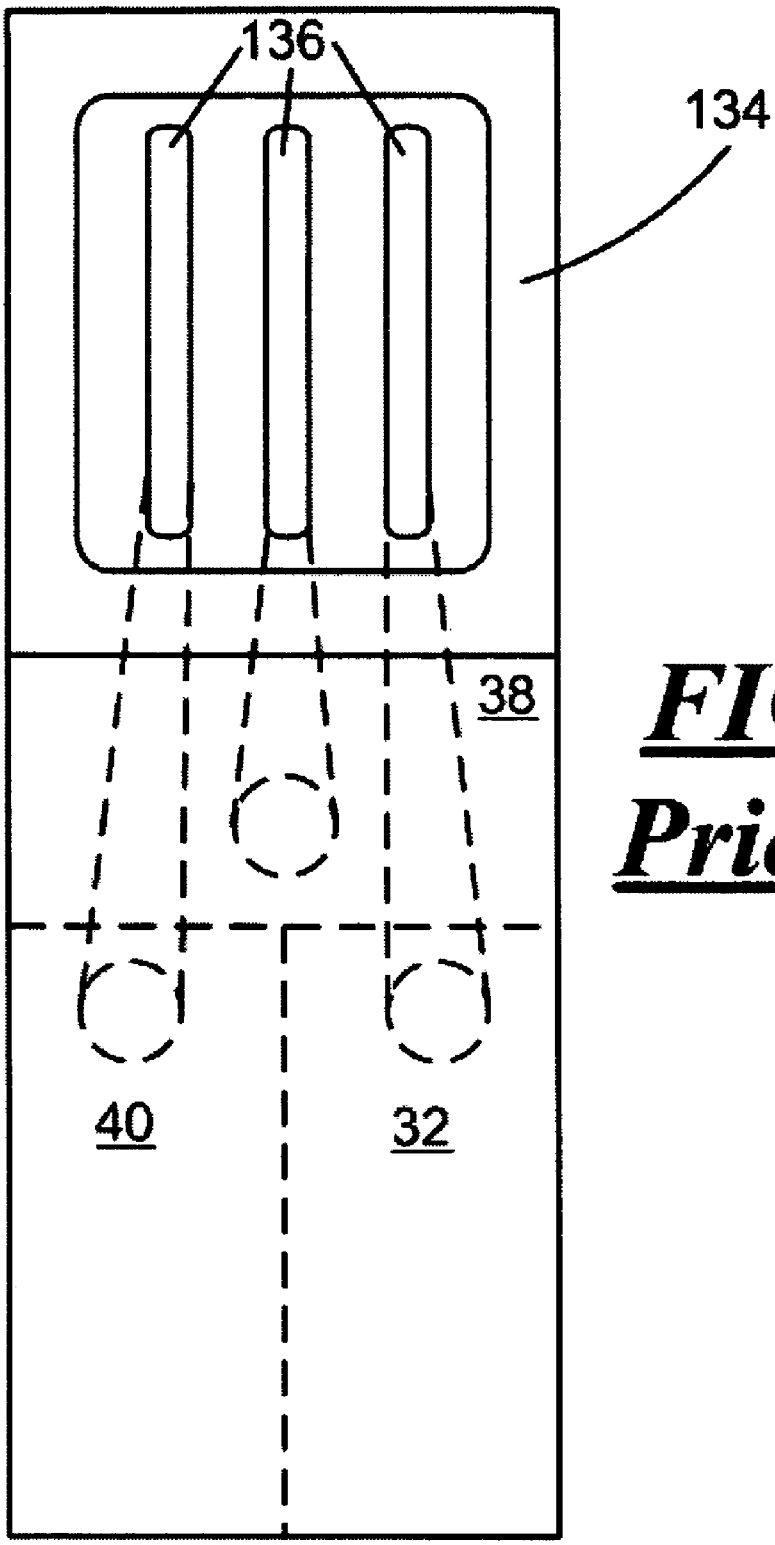
FIG. 21 Prior Art
FIG. 21 is a plan bottom view of a prior art multi-fluid body having fluid supply paths therein.

In another embodiment of the disclosure, the fluid flow path density of the ejection head 68 may be increased by altering the fluid flow paths through the substrate. Typically, fluid flow paths 130 in the substrate 132 are elongate, narrow slots that are formed through the thickness of the substrate 132, as seen in the prior art devices of FIGS. 19-20. Accordingly, body 134 of the prior art device of FIG. 21 contains corresponding elongate openings or fluid supply paths 136 therein for flow of fluid from chambers 32, 38, and 40. However, as set forth above, it is difficult to mold the body 134 to conform to the slot spacing of the substrate 132.

Figure 22:
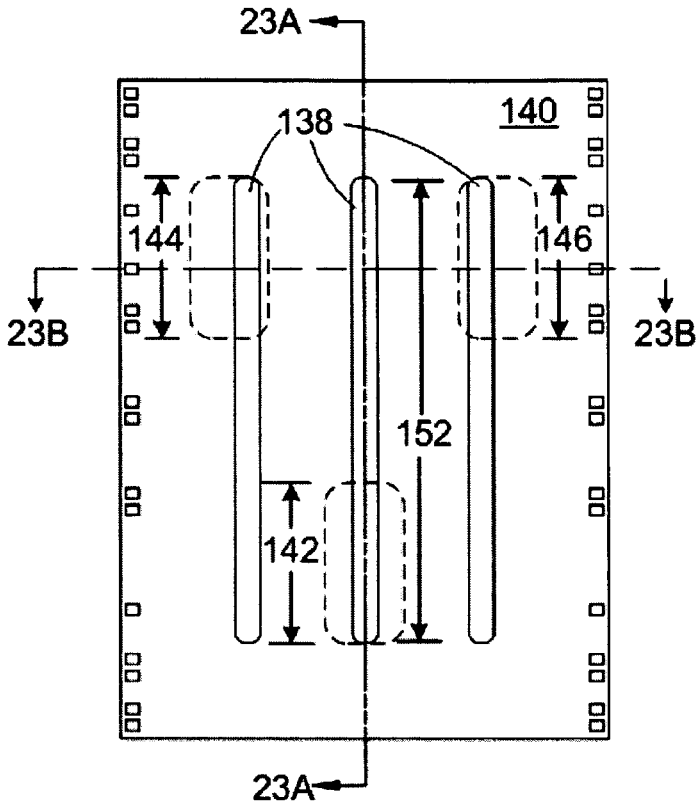
FIG. 22 is a plan view, not to scale, of a semiconductor substrate made according to a first embodiment of the disclosure.
Figure 23A:
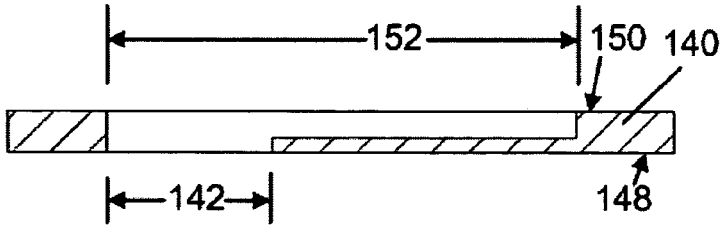
FIGS. 23A and 23B are cross-sectional views, not to scale, of a semiconductor substrate made according to the first embodiment of the disclosure.
Figure 23B:
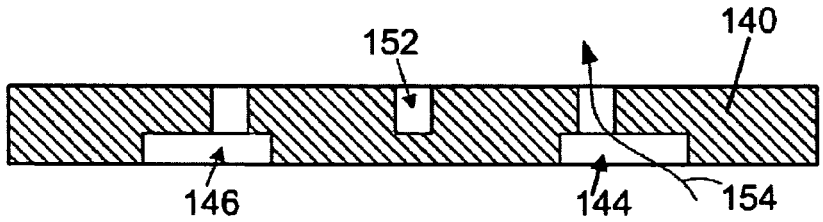

In another embodiment, a substrate is modified to enable easier molding of a fluid reservoir body to conform to the spacing of slots in the substrate. According to this embodiment, fluid flow paths 138 in a substrate 140 are formed using a two-step etching process to provide a substrate as illustrated in FIGS. 22-23B. According to the process, short, a portion of relatively wide slots 142, 144, and 146 are cut or etched all the way through the substrate 140 at one end of the fluid flow paths 138 from a first side 148 thereof.

In one embodiment, a deep reactive ion etching (DRIE) process is used to etch the slots 142-146. Using DRIE, for example, can provide slots having relatively parallel (as opposed to angled) side walls.

In one embodiment, at least one of the short slots 142, 144, and 146 is staggered with respect to the other short slots In certain embodiments, this may allow for the use of less substrate area. For example, staggering short slot 142 with respect to short slots 144 and 146 enables the short slots to be positioned in such a way that the combined width of the short slots 142, 144, and 146 is greater than a separation distance between respective outermost edges of short slots 144 and 146. Such a configuration of short slots 142-146 may provide for the use of a relatively narrower substrate 140 while still providing adequate surface area for adhesive application.

Full-length slots 152 are cut or etched half way through the thickness of the substrate 140 from either the first side 148 or from a second opposite side 150 of the substrate 140. The full length slots 152 intersect the short slots 142, 144, and 146 to provide fluid flow paths 138 through the substrate 140 as indicated by arrow 154.

Figure 24:
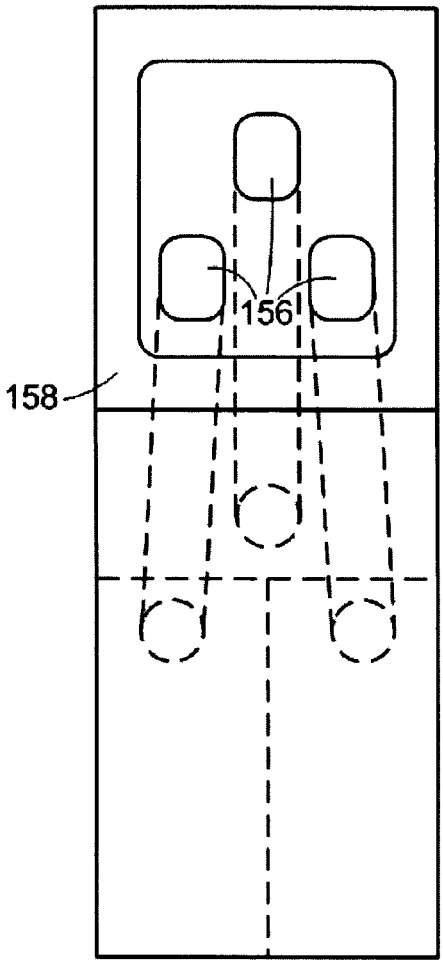
FIG. 24 is a plan bottom view, not to scale, of a body having fluid supply paths therein made according to the disclosure.

The openings 142, 144, and 146 have substantially the same open area as openings 152, however the openings 142-146 have a wider rectangular configuration as compared to the openings 152. The openings 142-146 on the first side 148 of the substrate 140 enable similarly shaped fluid supply paths 156 to be provided in a fluid reservoir 158 (FIG. 24). Because the fluid supply paths 156 in the reservoir 158 may be spaced closer together, the substrate 140 attached to the reservoir 158 may be provided with a smaller width and have a higher density of fluid flow paths 138 per width as described above. Accordingly, the substrate 140 width may be decreased from about 500 to about 700 microns, or more, using the embodiments described above. The foregoing arrangement of fluid flow paths 138 also provides an increased area for attaching and sealing the substrate 140 adjacent the fluid reservoir body 158.

Figure 25:
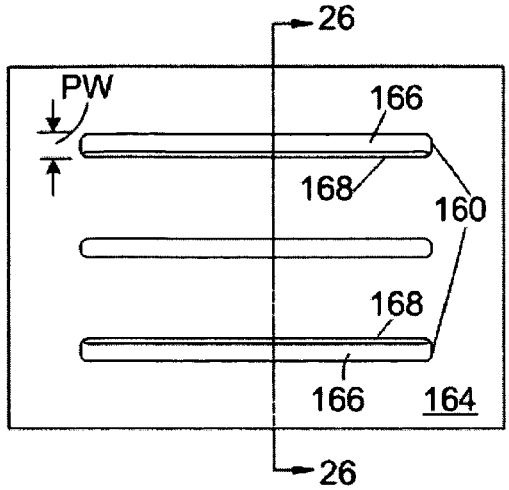
FIG. 25 is a plan view, not to scale, of a semiconductor substrate made according to a second embodiment of the disclosure.
Figure 26:
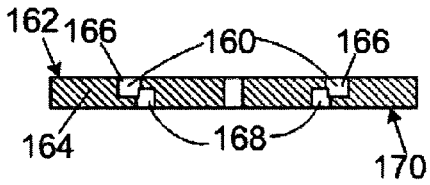
FIG. 26 is a cross-sectional view, not to scale, of a semiconductor substrate made according to the second embodiment of the disclosure.

Another slot arrangement that may be used to increase a distance between adjacent fluid flow paths 160 on a first side 162 of a substrate 164 is illustrated in FIGS. 25 and 26. Flow paths 160 in the substrate 164 are provided by an offset double side cut etch through portions of the substrate 164 as shown in FIG. 26. In this embodiment, first portions 166 of the flow paths 160 on the first side 162 of the substrate 164 are cut or etched two thirds of the way through the substrate 164. Second portions 168 of the flow paths 160 are cut or etched two thirds of the way through the substrate 164 from a second side 170 thereof. The first and second portions 166 and 168 are offset by nearly the flow path width PW. The two portions 166 and 168 intersect part way through the substrate 164 to provide a through passage for fluid in the substrate 164. Like the previous embodiment, this embodiment increases the width between the flow paths 160 on the fist side 162 of the substrate 164 by as much as two flow path widths PW, thereby providing an increased area for attaching and sealing the substrate 164 adjacent a fluid reservoir body.

Figure 27:
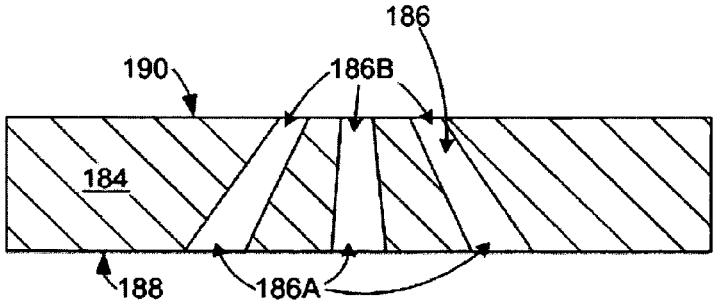
FIG. 27 is a cross-sectional view, not to scale, of a semiconductor substrate made according to a third embodiment of the disclosure.

In another embodiment, the substrate 184 may have angled flow paths 186 through the thickness of the substrate 184 so that the flow paths on one side of the substrate 184 are spaced farther apart than the flow paths on an opposite side of the substrate as shown in FIG. 27. Typically, flow paths 186A on a body side 188 of the substrate 184 will be spaced farther apart than flow paths 186B on a nozzle plate side 190 of the substrate 184.

Figure 28:
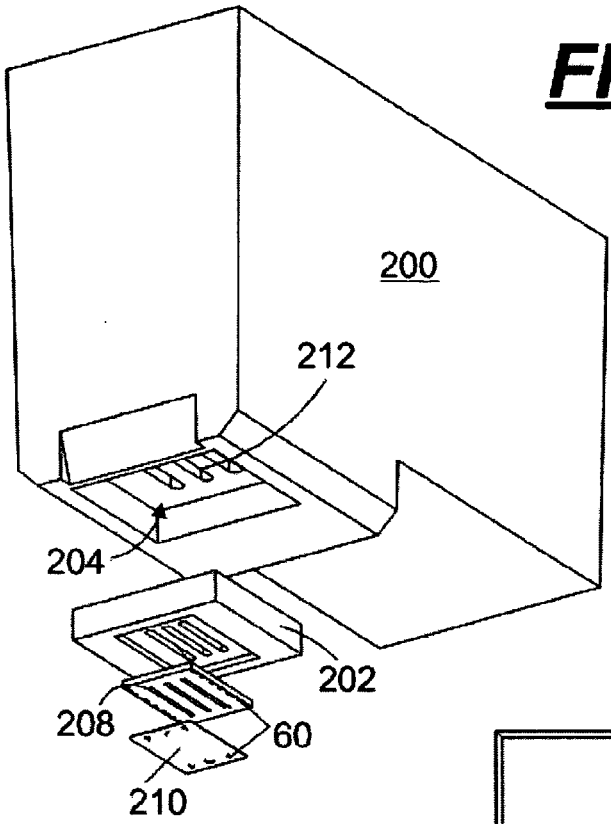
FIG. 28 is an exploded view, not to scale, of a body and manifold for a semiconductor substrate according to a first embodiment of the disclosure.
Figure 29:
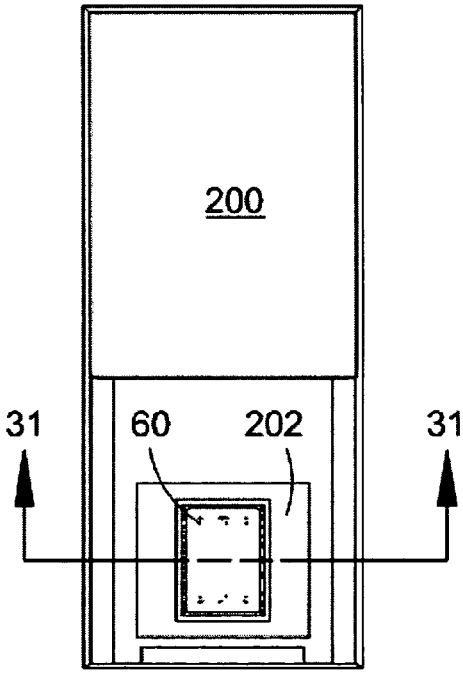
FIG. 29 is a plan bottom view of a body and manifold for a semiconductor substrate according to the first embodiment of the disclosure.
Figure 30:
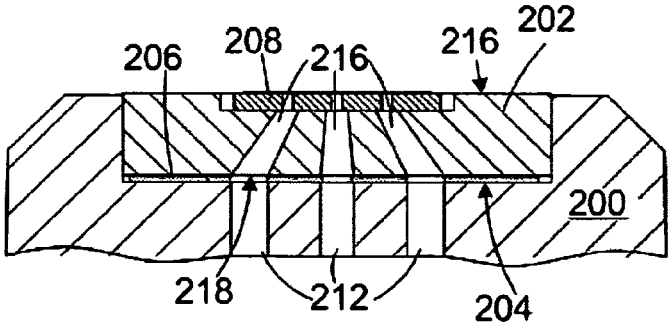
FIG. 30 is cross-sectional view, not to scale, of a semiconductor substrate and manifold attached to a body according to the first embodiment of the disclosure.

An increase in flexibility of design for smaller substrates may also be provided by use of one or more of the following embodiments incorporating a manifold structure. An illustration of a multi-fluid reservoir 200 containing a manifold 202 attached in a manifold pocket 204 of the reservoir 200 is illustrated in FIGS. 28-30. An adhesive 206 is preferably used to attach the manifold 202 in the manifold pocket 204 (FIG. 30).

As described in more detail below, the manifold 202 is used to create passages for the fluid from the reservoir 200 to a semiconductor substrate 208 and nozzle plate 210 providing the ejection head 60. The manifold 202 eliminates numerous challenges associated with a manufacturing process and mold design for injection molding of fluid supply paths 212 in the reservoir 200 and for attaching the substrate 208 to the reservoir 200.

Conventional attachment methods like ultrasonic welding are commonly used in industry to join polymeric components together. However, obtaining a hermetic seal with ultrasonic welding in a micro-fluid ejection system is very difficult if not impossible, due to the limitation in joint design and the uncontrollable flash generated during the welding process. In fact, debris and vibration often cause a substantial amount of yield loss. Adhesive bonding is a viable alternative for joining the manifold 202 to the fluid reservoir 200 to provide a hermetic seal between fluid supply paths 212. However, the adhesive usually takes a very long time to cure at room temperature and there is a risk of blocking the supply paths 212 due to the spreading of the adhesive into the supply paths 212.

One solution to adhesive spreading for the fluid reservoir 200 and ejection head 60 for a micro-fluid ejection device is to provide the manifold 202 with fluid flow channels 214 having a spacing on a substrate side 216 of the manifold 202 closer together than a channel spacing on the fluid reservoir side 218 of the manifold 202. In order to achieve such unequal spacing of the fluid flow channels 214 in the manifold 202, the fluid flow channels 214 are not parallel but are angled and converged together moving from side 218 to side 216 of the manifold 202. FIG. 30 illustrates a cross-sectional view of the manifold 202 having the converging fluid flow channels 214 therein coupled to the semiconductor substrate 208. With such a design, a conventional fluid supply path 212 spacing of the reservoir 200 can be used or the fluid supply paths 212 in the reservoir 200 may be made wide enough to increase the ease of molding the reservoir fluid supply paths 212 easier and to increase the ease of providing a hermetic seal between the manifold 202 and the reservoir 200.

The manifold 202 may be made from a variety of materials that are compatible with the fluids in the reservoir 200 including polymers and ceramics. Accordingly, the manifold 202 may be molded of a material that has a coefficient of thermal expansion (CTE) close to that of the semiconductor substrate 208 in order to reduce thermal stresses during adhesive curing of the substrate 208 to the manifold 202 and the manifold 202 to the reservoir 200. The manifold 202 may also be molded of a material that is transparent to an infrared laser beam that may be used to cure an adhesive between the substrate 208 and the manifold 202. Laser beam radiation curing is described in more detail below. The manifold 202 may be molded in a material that is very tough and flexible that is suitable for reducing the chances of cracking the substrate 208 from a drop impact of the reservoir 200 or ejection head 60.

For example, a ceramic manifold may be molded to contain a complex geometry and can also be modified through secondary processes, such as machining, to provide tighter tolerances and smaller features. A ceramic manifold may also be used in the same way that a plastic may be use to provide a manifold that would connect widely spaced apart fluid supply paths in a relatively cheap multi-fluid reservoir to closely spaced apart fluid flow paths in a substrate. If a tortuous path was necessary to create very complex flow features, multiple layers or plates of ceramic material may be bonded together to form such features. Reducing the limitations of a structure that a semiconductor substrate is then bonded to, can provide the benefit of being able to drastically reduce the size of the semiconductor substrate.

A ceramic manifold may also provide improved stability for the semiconductor substrate by maintaining greater flatness of the substrate. When in contact with a plastic body during a heating process, the substrate and plastic body tend to expand and contract at different rates. Such expansion and contraction causes stress on the substrate and can cause the substrate to bow. Substrate bow causes fluid delivery quality problems and fragility problems. Ceramic substrates maintain a very tight tolerance on flatness prior to substrate attachment which aids the substrate bonding process. With the use of a ceramic manifold the fluid flow path density, or number of flow paths per unit area, of the semiconductor substrate can be increased In another embodiment, a V-shaped manifold block 220 is provided as illustrated in FIGS. 31-33. The V-shaped manifold block 220 enables a multi-fluid reservoir 222 to be molded with a single axis slide for fluid supply paths 224 and keeps all intricate molding in the manifold block 220. The geometry and cross section of the manifold block 220 and reservoir body 222 are illustrated in FIGS. 32 and 33. A single axis slide that forms the fluid supply paths 224 may be pulled from a fluid exit side of the reservoir 222 thereby minimizing mold complexity. The manifold block 220 may be molded with simple side pulls.

Figure 19:
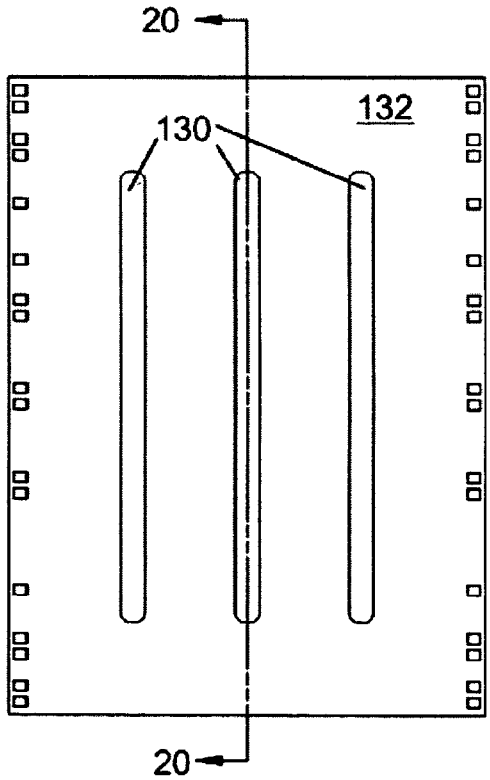
FIG. 19 Prior Art
FIG. 19 is a plan view, not to scale, of a prior art semiconductor substrate.

The next manifold embodiment includes a thin manifold plate 228 that is attached directly to the semiconductor substrate 208 by use of an adhesive. The manifold plate 228, has a design feature in such a way that each fluid flow channel 230 has a relatively narrow end 232 and relatively wide end 234 as illustrated in FIG. 34. Each wide end 234 has a passages through the thickness of the manifold plate 228 whereas the narrow end 232 only extends partially through the thickness of the plate 228. Adjacent fluid flow channels 230 are oriented such that the wide ends 234 that connect to fluid supply paths in the fluid reservoir are spaced apart as generally described above with reference to FIG. 26. The foregoing manifold plate 228 design enables a spacing between fluid flow paths 238 in the substrate 208 to be reduced by ⅓ as compared to the spacing of fluid flow paths 130 in a conventional substrate 132 as illustrated in FIG. 19.

The manifold plate 228 may be fabricated by laser ablation, deep reactive ion etching (DRIE), or the plate 228 may be micro-molded to provide the flow channels 230 therein. The manifold pate 228 may be compression bonded to the substrate 208 at the same time that a nozzle plate 210 (FIG. 28) is compression bonded to the substrate 208. Bonding of the manifold plate 228 to a semiconductor substrate 208 may be done while the substrate 208 is still part of a silicon wafer, prior to dicing to wafer to provide individual substrates 208.

As shown in FIG. 35, the foregoing manifold plate 228 enables a larger adhesive sealing area between fluid supply paths 240 on a reservoir body than a conventional design as shown in FIG. 36. The wide ends 234 of the fluid flow channels 230 have a large enough cross-sectional area so as not restrict fluid flow from the fluid reservoir. Accordingly, it is easier to apply an adhesive 242 to seal the plate 228 to the reservoir than an adhesive 244 used to seal a substrate to a reservoir in the conventional fluid flow path 136 design (FIG. 35).

In order to attach the manifold 202, 220, or 228 to the corresponding body 200, 222, or 182, a non-contact laser welding technique is preferably used because of the substantial high precision requirement for miniature features. Mask transmission laser welding is a precision welding technology developed by Leister Technologies. A line-shaped laser beam, is moved across the parts to be welded. The laser beam can reach the parts everywhere a weld line is desired, but is blocked in the other places by a mask placed between the parts and the laser. Mask laser welding may be used for welding together polymeric parts, which enables placing very precise and fine weld lines (less than 0.2 mm), on components to be welded. Such fine weld lines cannot be effectively achieved with conventional welding or bonding methods.

Other laser transmission welding methods that may be used to seal a manifold 202, 220, or 228 to its corresponding body 200, 222, or 182 include, but are not limited to fiber optics/waveguide based simultaneous welding or scanning type ND:YAG laser welding driven by two rotating mirrors. The fine weld lines provided by a laser welding process are able to provide a hermetic seal between flow paths and flow channels. However, the bond lines are fragile and the mechanical strength may not be strong enough to hold the manifold 202, 220, or 228 to the body 200, 222, or 182 because of the micro-sized weld lines. Therefore, auxiliary weld points are preferably provided to strengthen the joint and the miniature seal.

Figure 37:
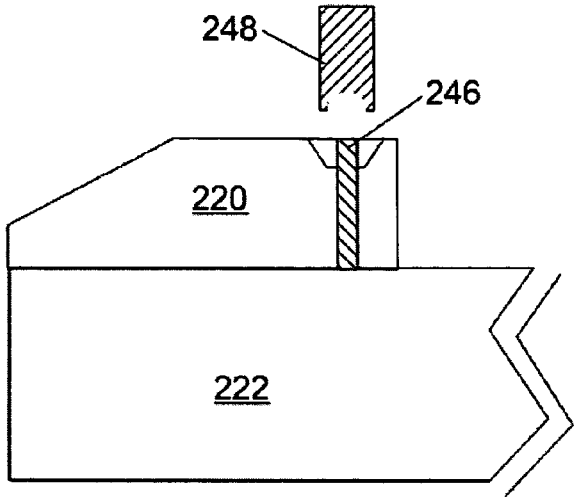
FIGS. 37-38 are schematic representations of a heat stake process for attaching a manifold to a body according to the disclosure.
Figure 38:
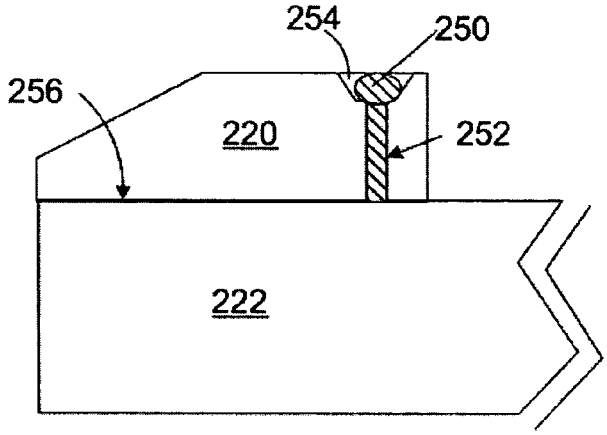
Figure 39:
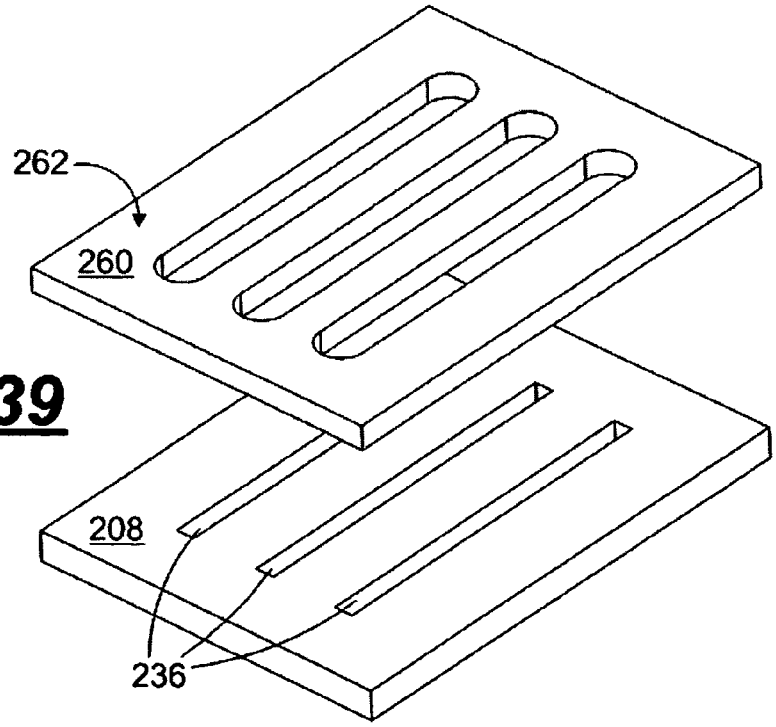
FIG. 39 is a perspective view, not to scale, of a die cut adhesive and semiconductor substrate according to the disclosure.

Auxiliary weld points may be provided as by use of heat staking. Heat staking is an assembly method that uses controlled melting and forming of a boss or stud to capture or lock another component in place. With reference to FIGS. 37 and 38, a suitable heat staking process is illustrated. According to the process, a stud 246 is made of a plastic or polymeric material. A hot iron 248 contacts the stud 246 and melts an end thereof to provide a stud head 250 that is wider than an opening 252 in the manifold through which the stud 246 extends. The stud head 250 is preferably recessed in a recessed area 254 of the manifold 220 so that the stud head 250 does not interfere with the head 60 attached to the manifold 220. With the combination of laser welding and heat staking in one process, the seal and the joint 256 between the manifold 220 and the body 222 are strong and durable.

Another method to create a micro-seal between adjacent fluid supply paths 212 in the body 200 and fluid flow paths 236 in a semiconductor substrate 208 that are closely spaced apart is to use a die cut adhesive gasket 260 instead of dispensing an adhesive bead to seal between the adjacent flow paths 236. The geometry of a die cut adhesive 260 can be controlled more precisely than dispensing an adhesive bead because its shape may be cold formed. A preferred die cut adhesive 260 is a thermally activatable, low melt adhesive that is compatible with the fluids in the body 200, such as ink. The die cut adhesive 260 may include a liner on one surface 262 thereof to aid in apply the adhesive 260 to the body 200. It will be appreciated that the die cut adhesive 260 may also be used to attach the substrate 208 to a manifold such as manifold 202, 220, or 228.

Figure 40:
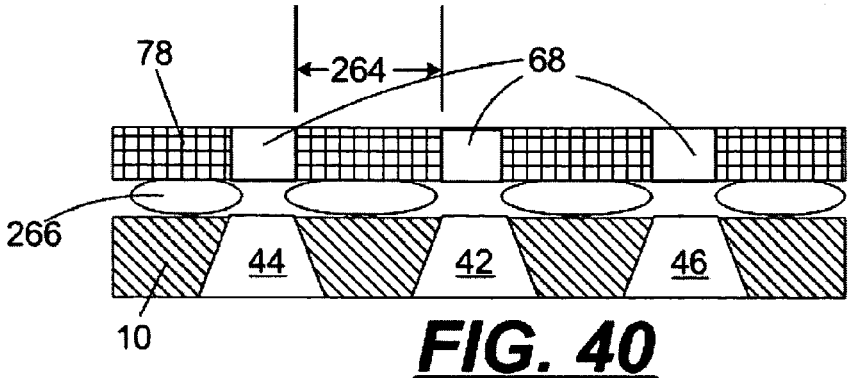
FIG. 40 Prior Art
FIG. 40 is a cross-sectional view, not to scale, of prior art application of a die bond adhesive between a semiconductor substrate and a multi-fluid body.

As shown in FIG. 40, the current die bond area 264 of the multi-fluid semiconductor substrate 78 for use in an ink jet printer, is around 0.6 mm in width. With the introduction of a separate manifold 202, 220, or 228, as described above, the die bond area 264 can be reduced to 0.1 mm. Materials that may be used as manifold materials for such applications include a styrene butadiene copolymer (SBC), polyphenylene ether/polystyrene alloy (PPE/PS), or a general purpose polystyrene (GPPS), which are transparent to infrared radiation and are also chemically compatible with the body material (i.e., NORYL N1250, NORYL N1251 for example) describe above. In the alternative, the manifold may be made of a thermoplastic polyester resin available from GE Plastics under the trade name VALOX. When a VALOX resin is used for the manifold, the body material is also preferably made of a polyester resin. When the die bond area 264 becomes smaller and smaller, precision alignment of the paths and/or channels is crucial.

Conventional adhesive 266 bonding will not give the placement accuracy required as the whole thermal mass is put inside an oven for curing at an elevated temperature. The thermal process typically results in part dislocation after cooling. On the other hand, the heat deflection temperature (HDT) of the body material must be higher than the baking temperature to avoid thermal deflection and deformation of the fluid supply paths 42, 44 and 46 in the body 10. Such requirement limits the choice of acceptable body materials. Thermal stress developed in the adhesive 266 area will also reduce the corrosion resistance of the structure.

Figure 41:
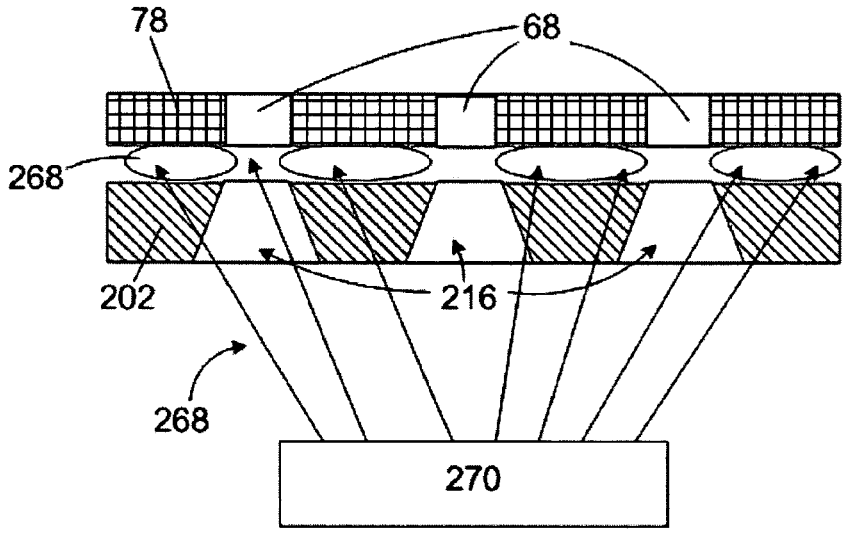
FIG. 41 is a schematic illustration of a laser curing process for an adhesive for attaching a semiconductor substrate to a manifold according to the disclosure.

In order to overcome the above problems and to bond the substrate 208 to the manifold 202 or body 200, localized or preferential heating may be used to cure the die bond adhesive 266. Since the manifold 202 is made of a material that is typically selected to be transparent to a laser beam 268 from a laser beam source 270, the manifold 202 can be used directly as a light transfer media (waveguide) to guide the infrared or laser beam 268 to the adhesive 266. In this way, heating is rapid and is localized and the adhesive 266 may be cured in minutes. The problems associated with die bond wicking into the flow paths 68 and flow channels 216 can be minimized because of the rapid curing of the adhesive 266. In addition, thermal stresses developed in the adhesive 266 area may be reduced. FIG. 41 illustrates use of rapid curing of an adhesive 266 with a laser beam 268 by use of a manifold 202 to guide the laser beam 268 to the adhesive 266.

When 266 adhesive is continuously exposed to infrared or laser radiation, overshooting of the adhesive may occur which damage intrinsic properties of the adhesive 266. In order to keep the adhesive 266 at any desired temperature for curing, pulse heating is may be used. An advantage of using pulse heating as opposed to continuous heating may be to enable time for the adhesive 266 to conduct heat to the substrate 78. When the heat generated in the adhesive 266 by infrared radiation equals the heat dissipated to the surrounding material 78, temperature of the adhesive 266 will reach an equilibrium level. Adjusting the frequency of the pulse, the pulse length, and the infrared/laser power, will provide a desired temperature for curing the adhesive 266.

Figure 42:
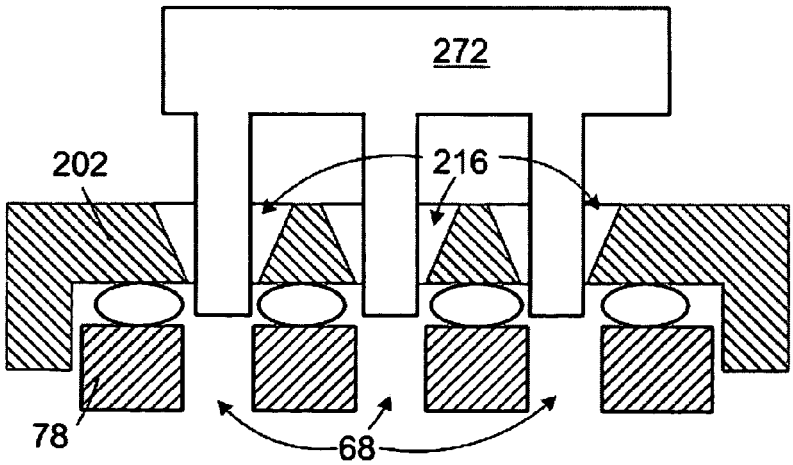
FIG. 42 is a schematic illustration of a light tube curing process for an adhesive for attaching a semiconductor substrate to a manifold according to another embodiment of the disclosure.

In another embodiment, the manifold 202 is not transparent to laser or infrared radiation. In this embodiment, illustrated in FIG. 42, a fiber optic tool or wave guide 272 that fits through the channels 216 in the manifold 202 is used to direct the infrared laser or ultra violet (UV) light beams into the die bond adhesive 266 for rapid curing of the adhesive. The adhesive 266 may be either UV activated or thermal activated by infrared radiation.

Figure 43:
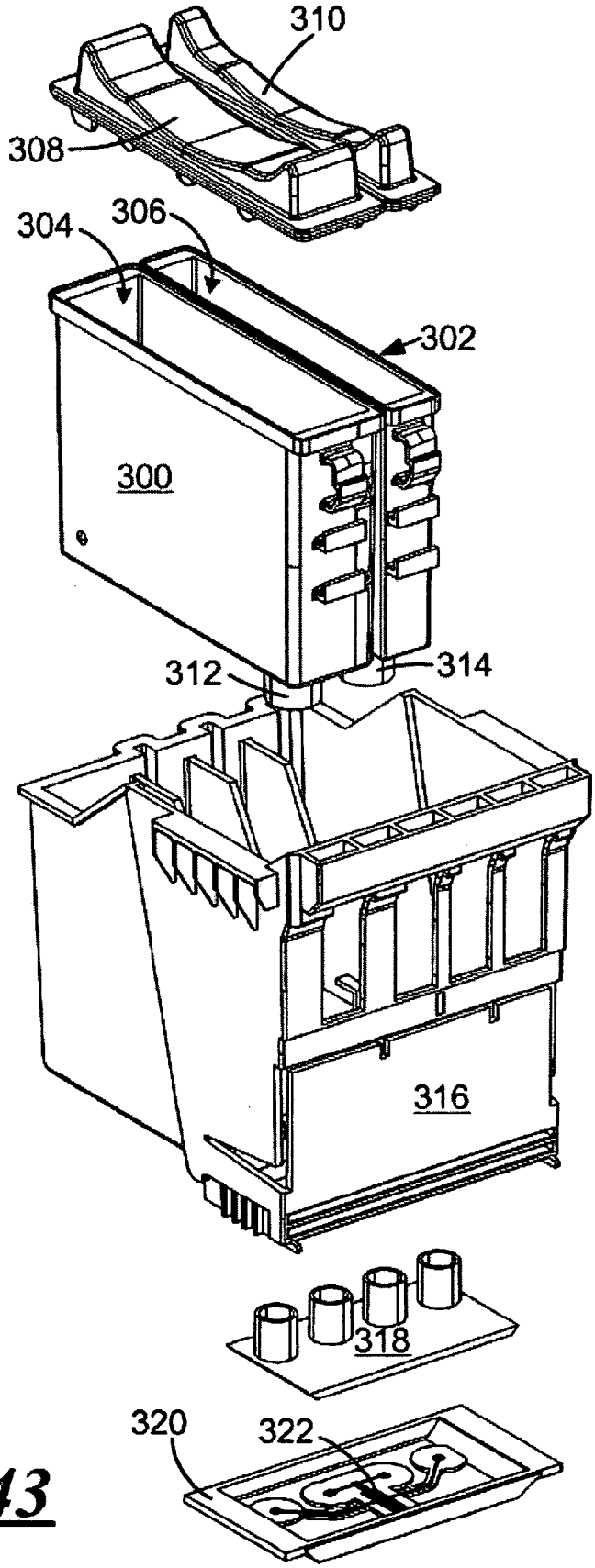
FIG. 43 is an exploded perspective view of a multi-fluid body construction according to the disclosure.
Figure 44:
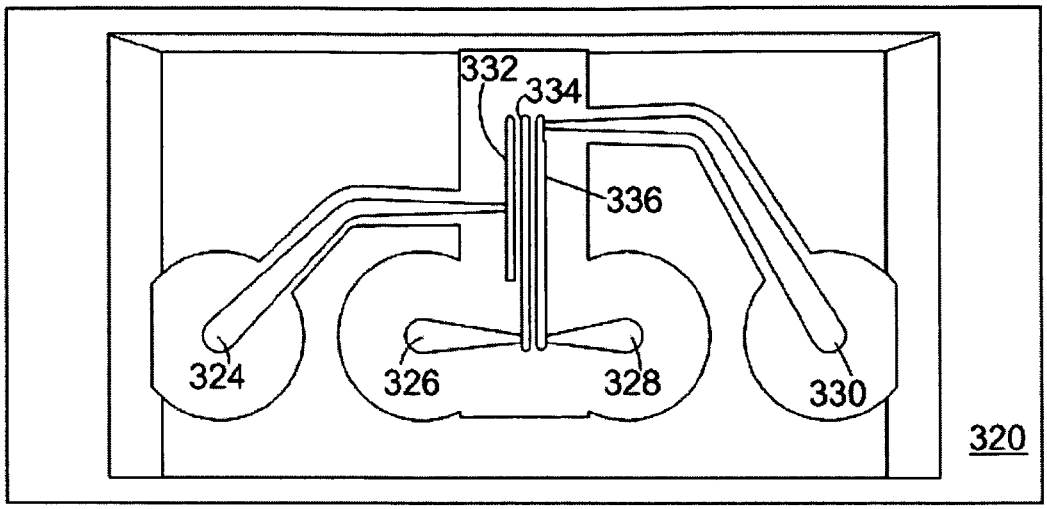
FIGS. 44-45 are plan views, not to scale, of manifolds for a multi-fluid body construction according to the disclosure.
Figure 45:
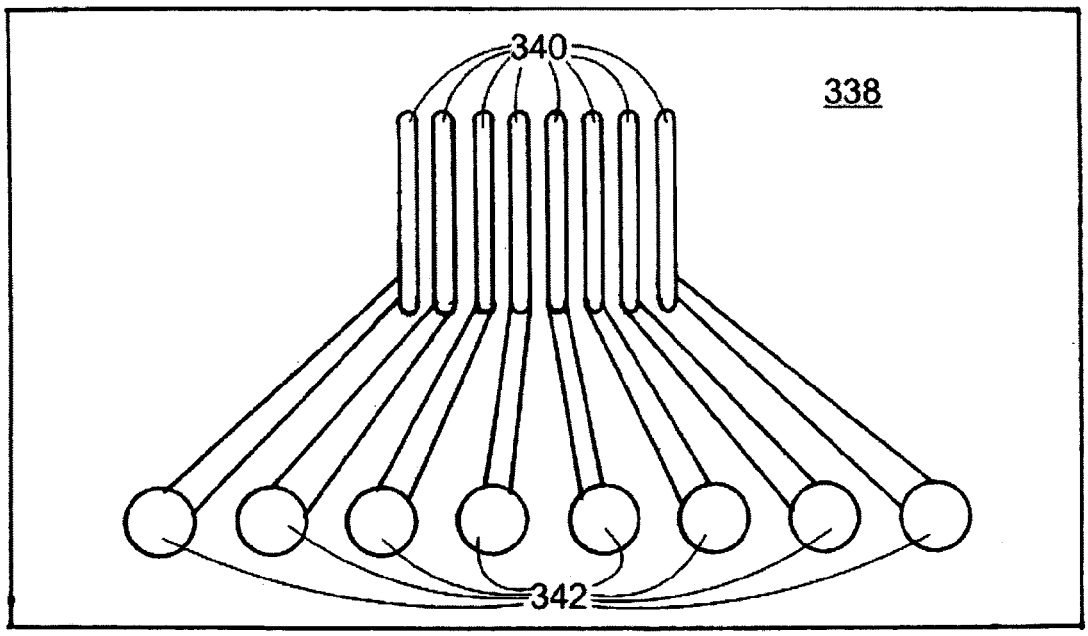

The use of a manifold structure as describe above enables other variations in fluid reservoir design as illustrated in FIGS. 43-45. In FIG. 43, instead of a single multi-compartmentalized body, individual fluid containers such as fluid containers 300 and 302 are provided. The fluid containers 300 and 302 have fluid cavities 304 and 306 for different fluids. The fluid cavities are closed by covers 308 and 310. A fluid outlet port 312, 314 is provided for each container 300, 302. The containers 300, 302 are inserted into a container housing 316 that contains a standpipe assembly 318 for fluidly coupling the outlet ports 312, 314 of the containers 300, 302 to a manifold 320. The outlet ports 312, 314 of the containers 300, 302 are fluidly coupled to the standpipe assembly 318 when the containers 300, 302 are disposed in the container housing 316.

The manifold 320 is shown in detail in FIG. 44. It is preferred that the manifold 320 and standpipe assembly 318 be made of the same or similar material, with at least one of the materials being translucent to laser radiation to enable laser welding of one component to the other. Micro molding techniques may be used to mold grooves and slots 322 in the manifold 320. The manifold 320 may be made of an engineered plastic which results in an as-molded flatness of about 0.02 mm. The engineered plastic preferably has a low thermal coefficient of expansion, a high deflection temperature (HDT), a high mechanical strength, and is transparent to laser radiation.

In the manifold illustrated in FIG. 44, the standpipe assembly 318 fluidly connects with inlet ports 324, 326, 328, and 330. Each of the inlet ports 324 and 326 feed separate flow channels 332 and 334 respectively. Inlet ports 328 and 330 may also feed separate flow channels, or as illustrate, may feed a common flow channel 336. It will be appreciated that more than three flow channels 332, 334, and 336 may be provided in the manifold with a corresponding number of inlet ports. For example, as shown in FIG. 45, manifold 338 contains eight flow channels 340 fed by eight corresponding inlet ports 342. As above, the inlet ports 342 are fluidly connected to a standpipe assembly for flow of different fluids from fluid reservoirs to through the manifold 336 and to an attached semiconductor substrate for ejecting the fluids.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A multi-fluid body and an ejection head substrate connected in fluid flow communication with the multi-fluid body for ejecting multiple fluids therefrom, the multi-fluid body comprising:

at least two segregated fluid chambers; and independent fluid supply paths from each of the fluid chambers providing fluid to multiple fluid flow paths in the ejection head substrate, the ejection head substrate being attached adjacent an ejection head area of the body, wherein the fluid flow paths in the ejection head substrate have a flow path density of greater than about one flow path per millimeter in the substrate.

2. The multi-fluid body and ejection head substrate of claim 1, wherein fluid supply paths corresponding to the fluid flow paths are partially molded and partially micromachined in a bottom portion of the body for independent fluid flow from each of the chambers to the ejection head substrate.

3. The multi-fluid body and ejection head substrate of claim 1, further comprising a manifold structure disposed between a bottom portion of the body and the ejection head substrate, the manifold containing fluid flow channels therein for fluid flow from the fluid supply paths of the body to the fluid flow paths of the substrate.

4. The multi-fluid body and ejection head substrate of claim 3, wherein the manifold comprises a ceramic manifold.

5. The multi-fluid body and ejection head substrate of claim 4, wherein the ceramic manifold comprises a multilayer ceramic structure having tortuous fluid channels therethrough.

6. The multi-fluid body and ejection head substrate of claim 3, wherein the manifold comprises a polymeric manifold containing fluid flow channels at least partially molded therein.

7. The multi-fluid body and ejection head substrate of claim 3, wherein the fluid flow channels in the manifold are angled through the manifold to provide a channel spacing on a first side of the manifold that is less than a channel spacing on a second side of the manifold.

8. The multi-fluid body and ejection head substrate of claim 3, wherein the manifold comprises a block having a trapezoidal profile with at least one fluid flow channel formed in an angled wall surface thereof.

9. The multi-fluid body and ejection head substrate of claim 3, wherein the manifold includes non-symmetrical fluid flow channels each having a wide end having an opening extending through a thickness of the manifold and a narrow end extending part way through the thickness of the manifold.

10. The multi-fluid body and ejection head substrate of claim 1, wherein the ejection head substrate has a fluid flow path density ranging from about 1.0 to about 3.0 fluid flow paths per millimeter.

11. The multi-fluid body and ejection head substrate of claim 1, wherein the body comprises at least three segregated fluid chambers for ejecting three different fluids onto a medium.

12. The multi-fluid body and ejection head substrate of claim 1, wherein the fluid supply paths are injection-molded in the multi-fluid body to provide a fluid supply path density ranging from about 1.0 to about 3.0 fluid supply paths per millimeter.

13. The multi-fluid body and ejection head substrate of claim 1, wherein the fluid supply paths in the body have a stepped opening width.

14. The multi-fluid body and ejection head substrate of claim 1, wherein the substrate contains fluid flow paths therein having an elongate trench on a first side of the substrate in fluid flow communication with a non-elongate opening on a second side of the substrate.

15. The multi-fluid body and ejection head substrate of claim 14, wherein the fluid flow paths are etched in the substrate using a deep reactive ion etching (DRIE) process.

16. The multi-fluid body and ejection head substrate of claim 14, wherein at least one of the fluid flow paths contains a non-elongate opening that is staggered with respect to another non-elongate opening for another one of the fluid flow paths.

17. The multi-fluid body and ejection head substrate of claim 1, wherein the substrate contains fluid flow paths angled through a thickness of the substrate so that fluid flow path openings on a first side of the substrate adjacent the body have a greater spacing of fluid flow path openings on a second side of the substrate.

18. The multi-fluid body and ejection head substrate of claim 1, wherein the substrate has a substrate thickness and contains etched fluid flow paths therein wherein each fluid flow path has a first trench on a first side of the substrate and a second trench on a second side of the substrate in fluid flow communication with the first trench, wherein the first and second trenches are offset from each other, and wherein the first and second trenches are partially etched through the thickness of the substrate.

19. The multi-fluid body and ejection head substrate of claim 1, wherein at least two of the fluid supply paths in the body are disposed to provide fluid to a single one of the fluid flow paths in the substrate.

20. An ink jet printer comprising the multi-fluid body and ejection head substrate of claim 1.

* * * * *